US006265667B1

(12) United States Patent
Stipes et al.

(10) Patent No.: US 6,265,667 B1
(45) Date of Patent: Jul. 24, 2001

(54) COAXIAL CABLE

(75) Inventors: Jason A. Stipes; Bradley G. Pope, both of Richmond, IN (US); Jeffrey A. Miller, Glasgow, KY (US)

(73) Assignee: Belden Wire & Cable Company, Richmond, IN (US)

( * ) Notice: Subject to any disclaimer, the term of this patent is extended or adjusted under 35 U.S.C. 154(b) by 0 days.

(21) Appl. No.: 09/006,712

(22) Filed: Jan. 14, 1998

(51) Int. Cl.[7] ..... H01B 7/18

(52) U.S. Cl. ..... 174/102 R; 174/36; 174/28; 174/103

(58) Field of Search ..... 174/36, 110 R, 174/113 R, 102 R, 103, 28

(56) References Cited

U.S. PATENT DOCUMENTS 2,203,232 1/1940 Osborne et al. ..... 91/68
3,291,741 12/1966 Monroe et al. ..... 252/76
3,295,917 1/1967 Cotton et al. ..... 21/2.5

(List continued on next page.)

*Primary Examiner*—Dean A. Reichard
*Assistant Examiner*—William H Mayo, III
(74) *Attorney, Agent, or Firm*—Robert F. I. Conte; Lee, Mann, Smith, McWilliams, Sweeney & Ohlson

(57) ABSTRACT

The present invention relates to a metallic shielded cable having a wire braid shield coated with a non-gel and non-powder anti-corrosion coating and also to a coaxial cable having a central solid copper or copper clad conductor having a copper surface coated with an anti-corrosion benzotriazole composition. Also, the present invention relates to the method of producing a coaxial cable by coating a copper or copper clad conductor with an anti-corrosion benzotriazole composition prior to extruding a dielectric insulation on the conductor and to a method of preparing a coaxial cable wherein the coaxial cable has an aluminum wire braid and coating the wire braid with an anti-corrosion composition of a metal ionomers of ethylene and acrylic acid copolymers with the metal selected from the group consisting of Zn, Ca, Na and Mg, prior to extruding an insulation jacket around the aluminum wire braid.

9 Claims, 1 Drawing Sheet

U.S. PATENT DOCUMENTS

| | | | | |
|---|---|---|---|---|
| 3,413,227 | | 11/1968 | Howard et al. | 252/51.5 |
| 3,425,954 | | 2/1969 | Ruzevick et al. | 252/392 |
| 3,452,038 | | 6/1969 | Randall et al. | 260/308 |
| 3,553,137 | | 1/1971 | Woods | 252/75 |
| 3,653,931 | | 4/1972 | Borchert et al. | 106/3 |
| 3,714,066 | | 1/1973 | King et al. | 252/389 A |
| 3,720,616 | | 3/1973 | Randell et al. | 252/51.5 R |
| 3,802,890 | | 4/1974 | Keeney | 106/14 |
| 3,895,170 | | 7/1975 | Tanaka et al. | 428/457 |
| 3,912,699 | * | 10/1975 | Flexmann, Jr. | 260/88.1 |
| 3,935,125 | | 1/1976 | Jacob | 252/389 A |
| 3,941,866 | * | 3/1976 | Ingraham | 264/135 |
| 3,985,503 | | 10/1976 | O'Neal, Jr. | 21/2.7 R |
| 3,989,863 | * | 11/1976 | Jackson et al. | 427/367 |
| 4,136,075 | | 1/1979 | Finn et al. | 260/29.6 |
| 4,202,796 | | 5/1980 | Jacob et al. | 252/389 A |
| 4,246,030 | | 1/1981 | Lipinski | 106/14.12 |
| 4,311,738 | * | 1/1982 | Chi | 427/387 |
| 4,317,744 | | 3/1982 | Levi | 252/389 |
| 4,343,660 | | 8/1982 | Martin | 148/6.14 R |
| 4,357,396 | | 11/1982 | Grunewalder et al. | 428/626 |
| 4,382,008 | | 5/1983 | Boreland et al. | 252/75 |
| 4,395,294 | | 7/1983 | Hobbins et al. | 148/6.14 R |
| 4,402,847 | | 9/1983 | Wilson et al. | 252/75 |
| 4,409,121 | | 10/1983 | Latos et al. | 252/389 A |
| 4,515,919 | | 5/1985 | Bradley et al. | 524/591 |
| 4,515,992 | * | 5/1985 | Gupta | 174/102 R |
| 4,545,842 | | 10/1985 | Parsons | 156/310 |
| 4,612,236 | | 9/1986 | Hsu et al. | 428/216 |
| 4,652,323 | * | 3/1987 | Butt | 156/51 |
| 4,657,785 | | 4/1987 | Kelly et al. | 427/255.6 |
| 4,671,825 | | 6/1987 | Ishiii et al. | 148/6.15 R |
| 4,676,834 | | 6/1987 | Treybig | 106/14.15 |
| 4,691,081 | * | 9/1987 | Gupta et al. | 174/105 R |
| 4,792,464 | | 12/1988 | Martenson | 427/156 |
| 4,826,726 | | 5/1989 | Maeda et al. | 428/379 |
| 5,061,566 | * | 10/1991 | Morgan | 428/423.1 |
| 5,085,696 | | 2/1992 | Muller et al. | 106/14.16 |
| 5,091,260 | | 2/1992 | Wong | 428/461 |
| 5,114,746 | | 5/1992 | O'Leary et al. | 427/118 |
| 5,128,065 | | 7/1992 | Hollander | 252/394 |
| 5,141,675 | | 8/1992 | Vanderpool et al. | 252/389.23 |
| 5,156,769 | | 10/1992 | Cha et al. | 252/395 |
| 5,211,881 | | 5/1993 | Muller et al. | 252/389.52 |
| 5,217,686 | | 6/1993 | Vanderpool et al. | 422/16 |
| 5,219,523 | | 6/1993 | Vanderpool et al. | 422/16 |
| 5,236,626 | | 8/1993 | Vanderpool et al. | 252/394 |
| 5,242,716 | | 9/1993 | Iwase et al. | 427/407.1 |
| 5,256,332 | | 10/1993 | Kessler | 252/396 |
| 5,283,280 | * | 2/1994 | Whyte et al. | 524/559 |
| 5,290,599 | | 3/1994 | Hegedus et al. | 427/407.1 |
| 5,290,839 | | 3/1994 | Hegedus et al. | 124/204 |
| 5,290,840 | | 3/1994 | Hegedus et al. | 124/204 |
| 5,294,519 | | 3/1994 | Mori et al. | 430/313 |
| 5,316,573 | | 5/1994 | Brusic et al. | 106/14.16 |
| 5,324,448 | | 6/1994 | Mayeaux | 252/194 |
| 5,344,589 | | 9/1994 | Miksic et al. | 252/392 |
| 5,382,367 | | 1/1995 | Zinkan et al. | 210/698 |
| 5,391,322 | | 2/1995 | Mayeaux | 252/394 |
| 5,391,686 | | 2/1995 | Jadhav et al. | 528/77 |
| 5,393,457 | | 2/1995 | Miksic et al. | 252/194 |
| 5,401,337 | | 3/1995 | Carlson et al. | 148/257 |
| 5,403,880 | | 4/1995 | Hegedus et al. | 524/204 |
| 5,411,677 | | 5/1995 | Pickering et al. | 252/389.1 |
| 5,414,211 | * | 5/1995 | Chan | 174/36 |
| 5,427,821 | | 6/1995 | Hegedus et al. | 427/385.5 |
| 5,441,773 | | 8/1995 | Rodzewich | 427/388.4 |
| 5,486,308 | | 1/1996 | Mayeaux | 252/194 |
| 5,486,334 | | 1/1996 | Hollander | 422/16 |
| 5,487,846 | | 1/1996 | Otomo | 252/389.61 |
| 5,503,775 | | 4/1996 | Rao et al. | 252/394 |
| 5,532,025 | | 7/1996 | Kinlen et al. | 427/388.1 |
| 5,539,032 | | 7/1996 | Hegedus et al. | 524/204 |
| 5,589,106 | | 12/1996 | Shim et al. | 252/387 |
| 5,597,514 | | 1/1997 | Miksic et al. | 252/390 |
| 5,606,152 | | 2/1997 | Higashiura et al. | 174/120 R |
| 5,614,037 | | 3/1997 | Keener | 148/537 |
| 5,648,324 | | 7/1997 | Honda et al. | 510/176 |
| 5,796,042 | * | 8/1998 | Pope | 174/102 SP |
| 5,949,018 | * | 9/1999 | Esker | 174/23 R |

* cited by examiner

COAXIAL CABLE

FIELD OF THE INVENTION

This invention relates to cables. More particularly the invention relates to coaxial cables and particularly CATV cables.

BACKGROUND OF THE INVENTION

Coaxial cables are generally susceptible to moisture migration between the insulation and the conductor. This moisture reacts with the metallic surface of the conductor and causes corrosion to develop on the conductor. This corrosion, in certain instances, is accelerated when there are corrosion elements such as salt.

The present method used to prevent corrosion for coaxial type cables is to have the insulation bonded to the conductor in such a manner that moisture may not attack the conductor. However, such a bond may interfere with the clean stripping of the insulation from the conductor.

Also, in many of the CATV type coaxial cables, the wire braid is generally protected by flooding the cable with a flooding agent usually made from polyethylene grease or similar gel-likes substances. This material is generally deposited between the metallic shield and the jacket of the cables. Alternatively some cables presently use an anti-corrosion powder which is also deposited between the metallic shield and the jacket of the cable. However, these methods provide a coaxial cable which is messy and difficult to install or replace in the field.

SUMMARY OF THE INVENTION

The present invention provides a coaxial cable having a central conductor having bonded thereto an anti-corrosion or corrosion inhibiting composition and having over the anti-corrosion composition an appropriate insulation. The anti-corrosion composition is such that it will bond to the insulation and allow a clean stripping of the insulation from the central conductor. Surrounding the insulation is a bonded laminated tape and a wire braid shield having bonded thereto an anti-corrosion composition. Surrounding the wire braid shield is a jacket.

Therefore, one object of the present invention is to provide a coaxial cable wherein the central conductor as a non-gel and non-powder anti-corrosion composition bonded to the central conductor, a shielding tape-wire braid combination having a non-gel and non-powder anti-corrosion composition bonded to the shielding tape-wire braid combination, said cable when subjected to a salt fog at 92°–97° F. for 144 hours has no corrosion on the shielding tape nor on the wire braid, and less than 1 inch corrosion migration for the central conductor.

It is another object of the present invention to provide a coaxial cable having a central copper conductor having bonded thereto an anti-corrosion composition of formaldehyde and [{Di-(2-hydroxyethyl)imino}methyl]Ar-Methyl-1-H-Benzotriazole, a dielectric insulation surrounding the corrosion protected, conductor, an aluminum tape surrounding the dielectric insulation and an aluminum wire braid surrounding the aluminum tape and the combination of aluminum tape and aluminum wire braid being coated with and having bonded thereto an anti-corrosion composition containing metal ionomers of polyethylene and acrylic acid copolymers wherein the metal is selected from Zn, Ca, Na and Mg, and the aluminum tape and aluminum braid combination have an insulation jacket extruded thereon.

Another object of the present invention to provide a coaxial cable having a central copper conductor having bonded thereto an anti-corrosion composition of formaldehyde and [{Di-(2-hydroxyethyl)imino}methyl]Ar-Methyl-1-H-Benzotriazole, a dielectric insulation surrounding the corrosion protected copper conductor, a copper tape surrounding the dielectric insulation and a copper wire braid surrounding the copper tape and the combination of copper tape and copper wire braid being coated with and having bonded thereto an anti-corrosion composition of formaldehyde and [{Di-(2-hydroxyethyl)imino}methyl]Ar-Methyl-1-H-Benzotriazole, and the copper braid combination have an insulation jacket extruded thereon.

A further object of the present invention is to provide a method of preparing a coaxial cable during the manufacture of the coaxial cable wherein a central copper conductor is coated with an aqueous emulsion having as its essential ingredients formaldehyde and [{Di-(2-hydroxyethyl) imino}methyl]Ar-Methyl-1-H-Benzotriazole, drying the composition on the conductor to bond the composition to the copper conductor, extruding and bonding a dielectric insulation onto the coated conductor, simultaneously wrapping the dielectric insulation with an aluminum tape and an aluminum wire braid wherein the aluminum wire braid surrounds the aluminum tape to form an aluminum tape-braid combination, coating the aluminum tape-braid combination with an aqueous emulsion of a metal ionomer of polyethylene and acrylic acid copolymer wherein the metal is selected from Zn, Ca, Na and Mg, and drying the aqueous emulsion coating to bond the polyethylene acrylic acid copolymer ionomer to the aluminum tape-braid combination to provide a corrosion protected aluminum tape-braid combination and extruding an insulation jacket around said aluminum tape-braid combination.

DETAILED DESCRIPTION OF THE INVENTION

Figure 1:
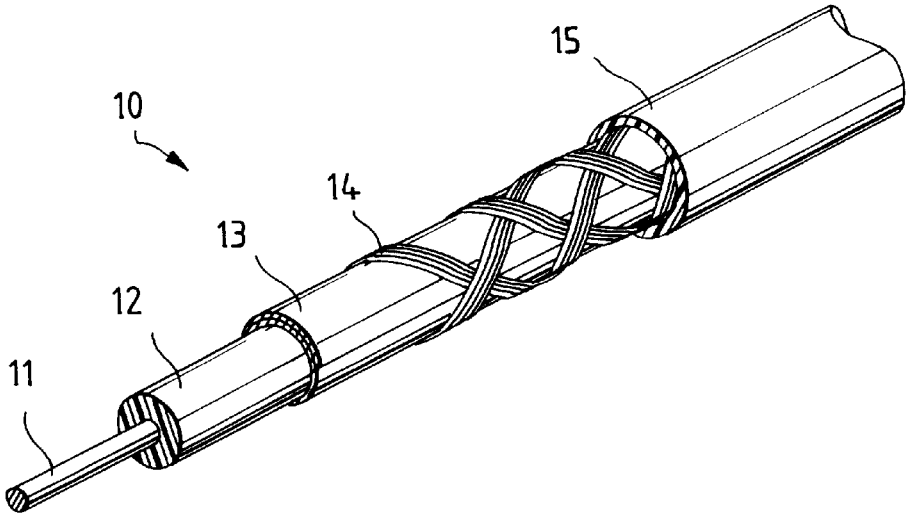
FIG. 1 shows a partial perspective view of a coaxial cable of the present invention.
Figure 2:
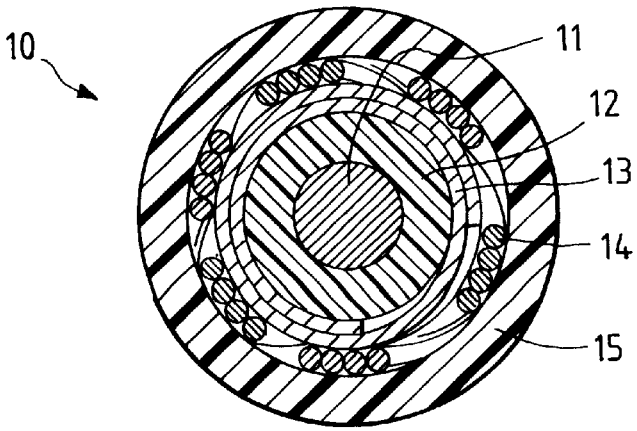
FIG. 2 shows an enlarged cross sectional view taken along line 2—2 of FIG. 1.

FIGS. 1 and 2 illustrate one type of CATV coaxial cable 10 made according to the present invention. The coaxial cable has a central conductor 11. The central conductor is shown as a solid conductor but can be twisted wire strands. The central conductor or wire strands are copper, i.e., solid copper or copper clad such as copper clad steel.

The copper has bonded thereto a copper anti-corrosion composition that will not interfere with the electrical and data transmission properties of the coaxial cable. The composition specifically utilizes a benzotriazole plus formaldehyde composition wherein the benzotriazole is [{Di-(2-hydroxyethyl)imino}methyl]Ar-Methyl-1-H-Benzotriazole.

The above aqueous benzotriazole copper anti-corrosion composition provides an effective and efficient manner of protecting the conductor. This copper anti-corrosion composition allows the central copper conductor 11 to be coated during the production process of the coaxial cable 10. The conductor 11 is coated with the aqueous emulsion by brushing the emulsion onto the conductor. The benzotriazole coating is then dried and bonded to the entire surface of the conductor 11. An alternative to coating by brushing would be to use appropriate spraying, dripping and submersion. If the conductor is twisted wire strands, the conductor is preferably protected subsequent to the twisting of wire strands into the conductor 11. However, each wire strand could be coated prior to being twisted into the conductor 11.

The benzotriazole anti-corrosion coating also allows the dielectric insulation 12 to be bonded to the conductor 11 with the ability of being cleanly stripped in the field from conductor 11.

The composition utilized is Oakite RM3131. The material safety data sheet for the compound states that the formaldehyde in the composition is less than 1% and that the benzotriazole is between 70–80%. The Oakite RM3131 is from Oakite Products Inc. of Berkley Heights, N.J.

The above Oakite liquid product is mixed with 80 to 99% by volume of water or other appropriate emulsion carrier, to form a unified emulsion and is coated on the solid copper or copper clad conductor by brushing the conductor with the aqueous Oakite RM 3131. If desired, the Oakite may be applied to the conductor by spraying, dipping or submersion of the conductor. The coating is then dried by passing the coated conductor through a heater at a temperature of approximately 150° F. to form a bonded anti-corrosion protection coating on the entire surface of the conductor 11 of less than 2 mils thickness.

After the coating is bonded to the conductor, the dielectric extrusion station where the dielectric insulation 12 is extruded onto the conductor. The insulation 12 can be any insulation utilized for coaxial cables and is preferably polyethylene and more preferably a combination of solid and foam polyethylene. As the dielectric insulation is cooled, it is bonded to the anti-corrosion coated conductor 11.

The cable with the formed dielectric insulation thereon is now delivered to the process station wherein a conductive tape 13 and metal braid 14 are substantially simultaneously wrapped around the dielectric insulation 12 so that the tape 13 is wrapped around the dielectric insulation and the braid 14 is wrapped around the tape 13. The tape and braid should have the same metal surfaces contacting each other. In this instance, the tape is selected from aluminum or copper foil, aluminum or copper foil having one side bonded to a polyester base, or aluminum or copper foil sandwiching a polyester base. The tape always has its metal surface in contact with the braid 14. The braid 14 shown is an open type braid but, of course, may be a tighter braid where the opening are not as noticeable. The braids generally used provide about 40–95% aluminum or copper coverage. The braid is made of aluminum or copper wire, or aluminum or copper clad wire. After wrapping the insulation with the tape-braid combination, the tape-braid combination is sprayed with an aluminum or copper anti-corrosion composition.

The composition preferably utilized to coat the aluminum tape-braid combination are the water based emulsions of the metal ionomers of polyethylene acrylic acid copolymer compositions commercially available as ACqua 220, ACqua 240, ACqua 250 and ACqua X8158 from Allied Signal Inc., Michelman Inc.

The preferred metals are zinc, calcium, sodium and magnesium with zinc and calcium being the preferred ionomers.

The composition preferably utilized to coat the copper tape-braid combination are the water based emulsions of formaldehyde and [{Di-(2-hydroxyethyl)imino}methyl]Ar-Methyl-1-H-Benzotriazole commercially available as Oakite RM 3131. The emulsion may also be applied by brushing, dripping, submersion or other similar methods. The coated tape-braid combination is dried by heaters located before the extruder for the jacket 15. The anti-corrosion composition is bonded to the braid and tape.

It appears from an inspection of the finished aluminum tape-braid cable that the sprayed coating of the aqueous metal ionomer of polyethylene acrylic acid copolymer migrates under the braid to also substantially coat the tape surface facing the braid.

The following example illustrates one of the products and method of the present invention.

EXAMPLE

During the manufacture of a coaxial cable having a solid copper covered steel central conductor having a diameter of about 1.0 mm, a polyethylene insulation of about 2 mils of solid polyethylene on the central conductor and 68 mils of foam polyethylene over the solid polyethylene, a bonded laminated tape wrapped around the foamed polyethylene, and a 60% aluminum braid wrapped around the Duobond® II tape, and a black polyvinyl jacket extruded over the braid, an aqueous emulsion of Oakite RM 3131 is brushed or wiped on the central conductor and then heated by passing the coated central conductor through an induction heater. The heater has a temperature of approximately 150° F. and the coated conductor has a temperature of approximately 140° F. as it reaches the extruder where the solid and foamed polyethylene are extruded onto the coated central conductor. The anti-corrosion coating has a thickness of less than 2 mil. The solid polyethylene bonds to the Oakite coating. The tape and braid are wrapped on the foamed polyethylene insulation. ACQua 250 is sprayed onto the tape-braid combination and then the coated tape-braid cable is heated to bond the ACQua 250 to the tape and braid and also to drive off the emulsifying liquid. The corrosion protected tape-braid cable has the black polyvinyl jacket extruded thereon.

A sample of the above coaxial cable was tested by salt fog test SCTE standard IPS-TP-017 wherein the cable is subject to salt fog at 92°–97° F. for 144 hours. The tested sample showed a corrosion migration of less than 1 inch—about ½ inch for the central conductor and no corrosion on the tape nor braid.

The presently used gel filled CATV cables when subjected to a salt fog at 92–97° F. for 144 hours showed no corrosion on the braid and tape, but had corrosion migration on the central conductor of more than 1 inch.

What is claimed is:

1. A metallic shielded cable comprising a wire braid shield coated with a non-gel and non-powder anticorrosion coating wherein the cable has a central conductor, a dielectric insulation surrounding the central conductor, a shielding tape surrounding the dielectric insulation, said wire braid shield surrounding the shielding tape and an insulating jacket surrounding said wire braid shield, wherein the central conductor is a solid copper or copper clad conductor with a copper surface wherein said copper surface has bonded thereon an anticorrosion coating, wherein said anticorrosion coating is a benzotriazole composition, wherein the benzotriazole composition contains formaldehyde and ({Di-(2-hydroxyethyl)amino}menthyl)Ar-Methyl-1-H-Benzotriazole.

2. The cable of claim 1 wherein the wire braid shield is an aluminum or aluminum clad and the anti-corrosion coating is selected from metal ionomers of ethylene and acrylic acid copolymers.

3. The cable of claim 2 wherein a metal of said metal ionomers is selected from the group consisting of Zn, Ca, Na and Mg.

4. The cable of claim 1 wherein the shielding tape is an aluminum tape and the wire braid is an aluminum or aluminum clad wire braid.

5. The cable of claim 4 wherein the aluminum tape is coated with the same non-gel and non-power anti-corrosion coating as the wire braid and the non-gel and non-powder anti-corrosion coating is bonded to the tape and braid and is selected from a metal ionomer of ethylene and acrylic acid copolymers a with said metal of said metal ionomer being selected from the group consisting of Zn, Ca, Na and Mg.

6. The cable of claim 5 wherein said metal ionomer is a metal ionomer of polyethylene and acrylic acid copolymers.

7. The cable of claim 1 wherein when said cable is subjected to a salt fog at 92°–97° F. for 144 hours, there is no corrosion of said wire braid shield.

8. The cable of claim 1 wherein said cable exhibits no corrosion of said wire braid shield and shielding tape and less than one inch corrosion migration for the central conductor; when said cable is subjected to a salt fog at 92°–97° for 144 hours.

9. A coaxial cable comprising a central solid copper or copper clad conductor having a copper surface coated with an anticorrosion benzotriazole composition wherein the benzotriazole composition contains formaldehyde and ({Di-(2-hydroxyethyl)amino}menthyl)Ar-Methyl-1-H-Benzotriazole.

* * * * *

UNITED STATES PATENT AND TRADEMARK OFFICE

CERTIFICATE OF CORRECTION

PATENT NO. : 6,265,667 B1
DATED : July 24, 2001
INVENTOR(S) : Jason A. Stipes; Bradley G. Pope; Jeffrey A. Miller It is certified that error appears in the above-identified patent and that said Letters Patent is hereby corrected as shown below:

Column 5, claim 5,
Line 2, delete "non-power" and insert -- non-powder --
Line 6, delete "a with" and insert -- and a --.

Signed and Sealed this

Twenty-sixth Day of March, 2002

*Attest:*

*Attesting Officer*

JAMES E. ROGAN
*Director of the United States Patent and Trademark Office*